US012623137B2

(12) United States Patent
Kerr et al.

(10) Patent No.: US 12,623,137 B2
(45) Date of Patent: May 12, 2026

(54) PORTABLE PITCHING LANE FOR SOFTBALL

(71) Applicant: One Corporation, Bettendorf, IA (US)

(72) Inventors: Andrew Kerr, Kirkwood, MO (US); John Robert Pieritz, Jr., Moline, IL (US); Michael Lee Sampson, Davenport, IA (US); Douglas Michael Kratz, Bettendorf, IA (US)

(73) Assignee: One Corporation, Bettendorf, IA (US)

( * ) Notice: Subject to any disclaimer, the term of this patent is extended or adjusted under 35 U.S.C. 154(b) by 306 days.

(21) Appl. No.: 16/572,374

(22) Filed: Sep. 16, 2019

(65) Prior Publication Data

US 2020/0215422 A1 Jul. 9, 2020

Related U.S. Application Data

(60) Provisional application No. 62/731,162, filed on Sep. 14, 2018.

(51) Int. Cl.
*A63C 19/12* (2006.01)
*A63B 69/00* (2006.01)

(52) U.S. Cl.
CPC ..... *A63C 19/12* (2013.01); *A63B 69/0002* (2013.01); *A63B 2069/0006* (2013.01)

(58) Field of Classification Search
CPC ..... A63C 19/12; A63C 19/02; Y10S 273/13; E01C 13/08; A63B 69/0002; A63B 69/0006
See application file for complete search history.

(56) References Cited

U.S. PATENT DOCUMENTS 1,679,374 A * 8/1928 Reirden ..... A63B 69/3661 428/17
3,181,863 A * 5/1965 Nellermoe ..... A63C 19/04 473/499
3,242,509 A * 3/1966 Nissen ..... E04F 15/22 5/420
3,319,273 A * 5/1967 Solin ..... A63B 6/00 5/420
3,599,982 A * 8/1971 Elesh ..... A63B 69/3661 473/278
3,703,285 A * 11/1972 Perry ..... A63C 19/04 473/497
3,935,352 A * 1/1976 Toland ..... E01C 13/08 428/95
4,040,632 A * 8/1977 Pawl ..... A63B 69/38 473/213
4,311,312 A * 1/1982 O'Brien ..... A63B 69/3661 473/218

(Continued)

FOREIGN PATENT DOCUMENTS

WO WO-2010131789 A1 * 11/2010 ..... E01C 13/08

*Primary Examiner* — John E Simms, Jr.
*Assistant Examiner* — Amir A Klayman
(74) *Attorney, Agent, or Firm* — Winthrop & Weinstine, P.A.

(57) ABSTRACT

Novel and advantageous portable pitching lanes for softball are disclosed. In one embodiment, a pitching lane for softball is disclosed comprising a foundation layer, a surface layer, and a pitching rubber. The portable pitching lane is movable from place to place when not in use, but does not move when in use.

14 Claims, 13 Drawing Sheets

(56) References Cited

U.S. PATENT DOCUMENTS 4,350,721 A * 9/1982 Nagase ..... A44B 19/34 160/DIG. 18
4,561,653 A * 12/1985 Wright ..... A63B 71/00 473/497
4,591,154 A * 5/1986 Santarone ..... A63B 69/0002 473/497
4,666,155 A * 5/1987 Stille ..... A63B 69/0002 273/DIG. 8
4,779,796 A * 10/1988 Lai ..... A63B 69/3652 473/279
4,799,681 A * 1/1989 Pipik ..... A63B 69/0013 473/415
4,810,560 A * 3/1989 Sell ..... A63B 69/0013 428/157
4,844,470 A * 7/1989 Hammon ..... A63B 69/3661 473/278
4,856,779 A * 8/1989 Wallendal ..... A63B 69/0002 473/497
4,875,685 A * 10/1989 Ballinger ..... A63B 69/3661 473/262
4,887,811 A * 12/1989 Tresh ..... A63B 6/00 473/451
4,932,656 A * 6/1990 Pierce ..... A63B 69/3667 473/452
5,004,243 A * 4/1991 Dlouhy ..... A63B 69/3661 473/279
5,028,052 A * 7/1991 Miller ..... A63B 69/3661 273/DIG. 31
5,066,000 A * 11/1991 Dolan ..... A63B 23/0464 472/92
5,110,133 A * 5/1992 Durso ..... A63B 69/3667 273/DIG. 30
5,116,045 A * 5/1992 Jahoda ..... A63B 69/004 472/92
5,263,863 A * 11/1993 Stefani ..... A63B 69/3673 473/269
5,460,379 A * 10/1995 Cleland ..... A63B 69/3652 473/279
5,467,977 A * 11/1995 Beck ..... A63B 69/0013 473/497
5,540,430 A * 7/1996 Nichols ..... A63B 69/0002 473/417
5,645,494 A * 7/1997 Dionne ..... A63B 69/3667 473/270
5,716,295 A * 2/1998 Anglea ..... A63C 19/06 473/497
5,916,036 A * 6/1999 Hamilton ..... A63B 69/3667 473/269
6,001,026 A * 12/1999 Breneman ..... A63B 69/3623 473/278
6,386,996 B1 * 5/2002 Foster ..... A63B 69/0002 434/252
6,395,362 B1 * 5/2002 Pacione ..... A47G 27/0487 428/95
6,422,872 B1 * 7/2002 Outlaw ..... A63B 69/0002 434/247
6,669,572 B1 * 12/2003 Barlow ..... E01C 13/08 473/162
6,843,739 B2 * 1/2005 Putnam ..... A63B 69/0002 473/451
6,945,883 B1 * 9/2005 Williams ..... A63B 69/0002 473/422
7,335,117 B2 * 2/2008 Reason-Kerkhoff ..... A63B 69/0002 473/217
D602,553 S * 10/2009 Wright ..... D21/780
7,621,831 B2 * 11/2009 Roberts ..... A63B 69/0002 473/497
8,029,426 B2 * 10/2011 Sohn ..... A63B 23/0211 482/145
8,167,746 B2 * 5/2012 Massaro ..... A63B 69/0013 473/497
8,216,095 B2 * 7/2012 Weber ..... E01C 13/08 473/497
8,740,731 B2 * 6/2014 Miller ..... A63B 69/0002 473/422
8,784,230 B1 * 7/2014 Mitchell ..... A63B 69/0059 473/271
8,882,615 B2 * 11/2014 Adair ..... A63B 71/02 473/497
8,944,941 B2 * 2/2015 Carlson ..... A63B 69/0002 473/499
9,022,884 B2 * 5/2015 Dunno, Jr. ..... A63B 69/0002 473/452
9,067,117 B1 * 6/2015 Chacon ..... A63B 69/3621
9,227,124 B1 * 1/2016 Sparks ..... A63B 69/0002
9,474,954 B2 * 10/2016 Lee ..... A63B 71/02
9,586,121 B1 * 3/2017 Carlson ..... A63B 69/3623
9,670,626 B2 * 6/2017 Karmie ..... E04B 5/48
9,724,581 B2 * 8/2017 Tyndall ..... A63B 69/0013
9,750,997 B2 * 9/2017 Frampton ..... A63B 5/22
10,456,652 B2 * 10/2019 Mack ..... A63B 69/3673
10,471,323 B1 * 11/2019 Carlson ..... A63B 71/02
10,716,987 B1 * 7/2020 Baldwin ..... A63B 69/0071
10,786,723 B1 * 9/2020 Loftus ..... A63B 69/3661
D905,186 S * 12/2020 Meredith ..... D21/780
10,888,756 B1 * 1/2021 Vasi ..... A63B 67/02
11,000,748 B1 * 5/2021 Krystosek ..... A63B 69/0002
D927,624 S * 8/2021 McHugh ..... D21/780
D937,951 S * 12/2021 Morris ..... D21/792
2005/0096147 A1 * 5/2005 Schmidt ..... A63B 24/0003 473/278
2006/0010705 A1 * 1/2006 Dettellis ..... G01B 3/11 33/756
2006/0142099 A1 * 6/2006 Trucks ..... A63B 69/0002 473/452
2008/0242452 A1 * 10/2008 Brennan ..... A63B 69/0002 473/415
2009/0124436 A1 * 5/2009 Nimmons ..... A63B 69/0013 473/501
2009/0233740 A1 * 9/2009 Gensler ..... A63B 69/0002 473/497
2009/0270206 A1 * 10/2009 Massaro ..... A63B 69/0013 473/497
2010/0197471 A1 * 8/2010 Hayes ..... A63B 21/4039 482/140
2011/0021296 A1 * 1/2011 Johnston ..... A63B 69/0002 473/452
2012/0065003 A1 * 3/2012 Trout ..... A63B 69/0002 473/454
2012/0142455 A1 * 6/2012 Smart ..... A63B 69/0002 473/451
2012/0178546 A1 * 7/2012 Park ..... A63B 69/3673 473/278
2013/0345000 A1 * 12/2013 Gangwer ..... A63B 69/0002 473/497
2014/0018197 A1 * 1/2014 Clark ..... A63B 69/0013 473/499
2020/0147467 A1 * 5/2020 Lawhon ..... A63B 63/00
2020/0375280 A1 * 12/2020 Beaudry ..... A61F 5/0123
2021/0388237 A1 * 12/2021 Takashima ..... C09J 201/00
2023/0094617 A1 * 3/2023 Clark ..... A63C 19/065 29/402.08

* cited by examiner

PORTABLE PITCHING LANE FOR SOFTBALL

FIELD OF THE INVENTION

The present disclosure relates to novel and advantageous pitching lanes for softball. More particularly, the present disclosure relates to novel and advantageous portable pitching lanes for softball.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

There is a need in the art for a device that protects artificial turf at the pitching lane of a softball field. Turf fields are used as opposed to real grass and clay fields to eliminate mud and prevent rain-outs. However, artificial turf can be damaged or destroyed, particularly at the pitching lane of a softball field. During fast-pitch softball, a pitcher drags her foot as she throws the ball, which can expose the turf to tears or other damage. The repeated motion of dragging the foot across turf in the same general area of the pitching lane can cause a large depression to occur in the base layer beneath the turf. This type of damage can occur quickly. For example, within a single game the turf can be damaged or destroyed, and/or a disruptive depression can develop in the base layer beneath the turf, which can be expensive and time-consuming to repair and/or negatively affect pitching performance.

Softball is frequently played in tournaments that occur over a number of days with multiple teams rotating play on a number of fields. Artificial turf at the pitching lane of a field can sustain damage during play and the extent of damage that occurs over multiple fast-pitch softball games, such as the number of games typically played over the course of a tournament, can cause the softball pitching lane to become unusable. At least because softball has only relatively recently been played on artificial turf, no satisfactory solution has been developed that is cost-effective, easily maneuvered, adaptable for use with players of different age groups, and that does not affect the pitchers feel of the mound as she pitches. Accordingly, quick and imperfect solutions have been improvised that allow play to continue.

One solution has been to add rubber protective pellets over the damaged turf between each game. The goal with this is that the rubber pellets help the turf stand up and prevent it from tearing. This requires continually adding pellets and continually back-filling to keep the turf in working condition. While this solution temporarily addresses the damage to the turf, it does not correct the depression that occurs in the base layer of the turf. Other solutions that have been attempted include using a sand and water mix that is poured over large sections of the turf on the pitching lane. While there may be some protective component to this solution, it is very messy and the water evaporates, requiring more of the mix to be applied, resulting in a great deal of sand in the turf. Thus, these remedies are not satisfactory.

Therefore, there is a need in the field for a solution that is cost-effective, prevents, eliminates, or quickly repairs or replaces damaged turf, and prevents a depression from forming in the base layer of the turf. Further, there is a need for a solution that can be used with players of all ages and that can be easily moved on and off the field or from one field to another.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

The present disclosure, in one or more embodiments, relates to a portable pitching lane. The portable pitching lane may comprise a foundation layer, a surface layer, and a pitching rubber. The portable pitching lane is movable from place to place when not in use but does not move when in use.

In another embodiment, a foldable portable pitching lane is provided including a first component piece and a second component piece. The first component piece comprises a first piece foundation layer and a first piece surface layer. The second component piece comprises a second piece foundation layer and a second piece surface layer. A hinge connects the first component piece to the second component piece. The foldable portable pitching lane is movable from place to place when not in use, but does not move when in use.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure relates to novel and advantageous pitching lanes for softball. More particularly, the present disclosure relates to novel and advantageous portable turf pitching lanes.

Figure 1:
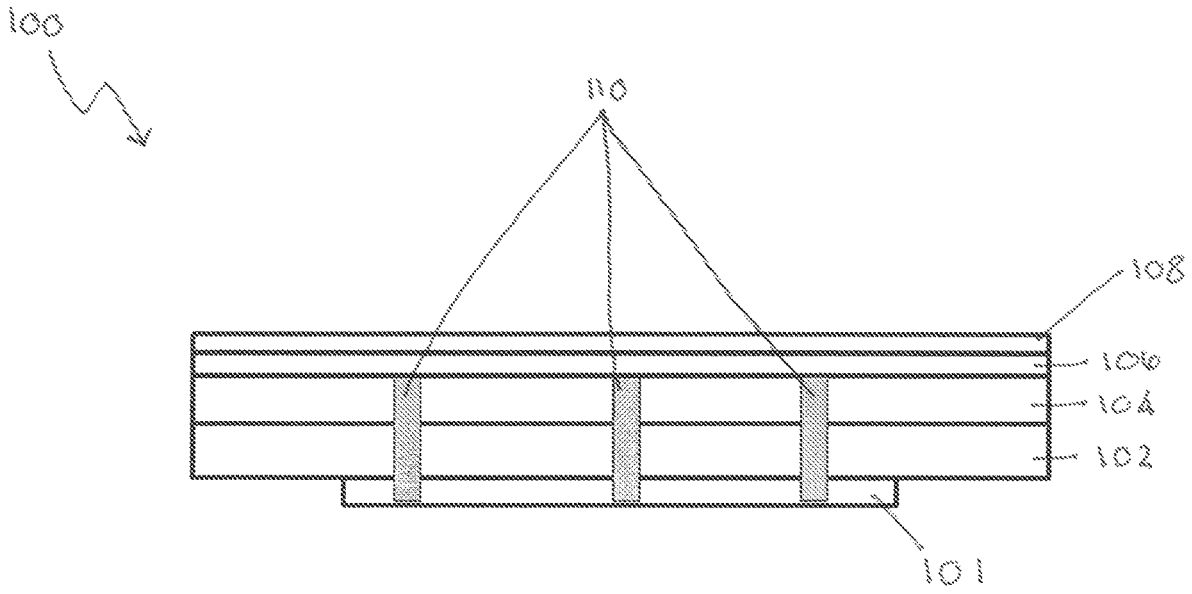
Fig. 1 PRIOR ART
FIG. 1 illustrates a cross-sectional view of a typical build-up of artificial turf.

Relatively recently, fast-pitch softball has begun to be played on fields made of artificial turf. Artificial turf may be beneficial over real grass and clay fields because the playing surface may be generally more uniform, will not turn to mud, and can be played on in the rain. Further, artificial turf may be generally easier to maintain than fields made of real grass and clay. FIG. 1 illustrates a cross-sectional view of a typical build-up of artificial turf 100. First a perimeter collection pipe 101 may be installed. Subgrade 102 may be laid over the perimeter collection pipe 101. Woven fabric 104 may be placed over the subgrade 102. One or more drains 110 may be installed such that any water may drain down to the perimeter collection pipe 101. Next, a base stone 106 may be installed and rolled smooth. Finally, artificial turf 108 is laid down. It will be understood that many varieties of artificial turf exist and that the present disclosure provides embodiments that may be used with any type of known or after-arising artificial turf.

Figure 2:
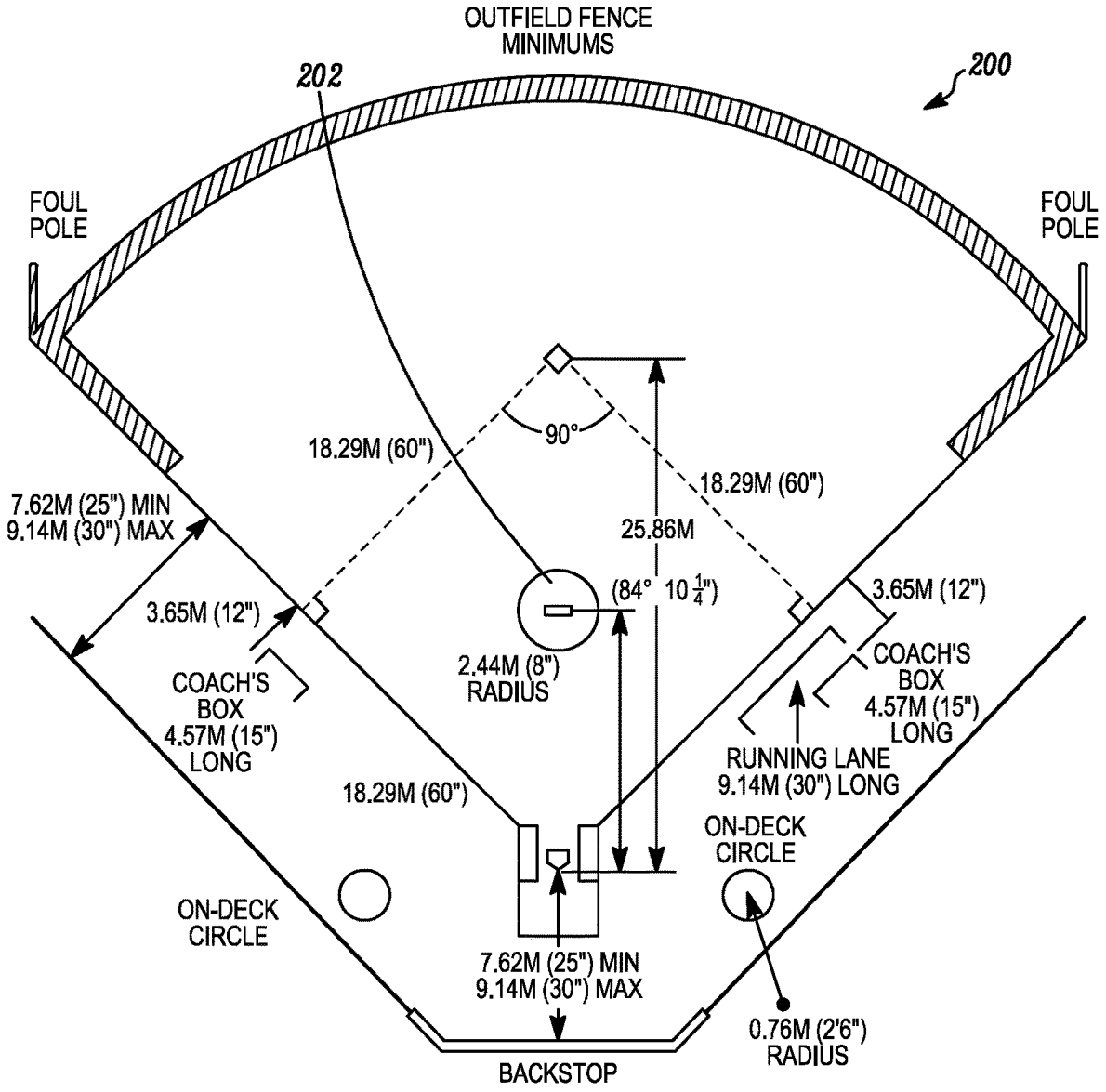
FIG. 2 PRIOR ART
FIG. 2 illustrates a typical softball field, including the softball pitcher's circle.

FIG. 2 illustrates a typical softball field 200, including the softball pitcher's circle 202. The pitcher's circle typically has an 8 foot radius (thus a 16 foot diameter). In softball, the pitcher's circle is not raised as a pitching mound is in baseball, but is typically flush or near flush with the rest of the ground.

Figure 3:
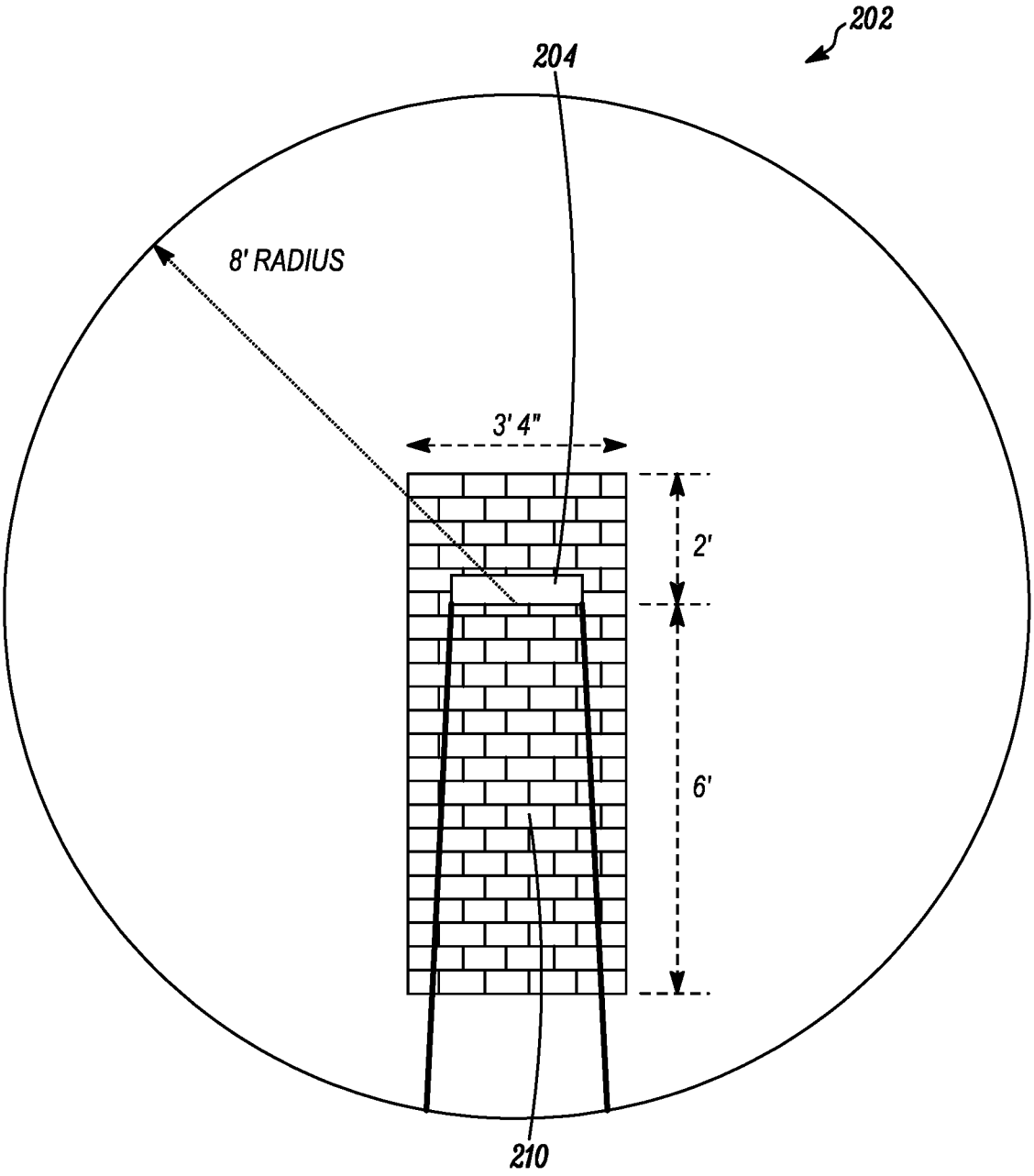
FIG. 3 PRIOR ART
FIG. 3 illustrates a softball pitcher's circle.

FIG. 3 illustrates a closer view of the softball pitcher's circle 202. As shown, a pitching lane 210 and pitching rubber 204 are provided in the pitcher's circle 202. The pitching lane 210 is typically 3'4" wide and 8 feet long. The front, center edge of the pitching rubber 204 is positioned in the pitcher's circle 202 according to the governing softball body and league. In general, the pitching rubber is set at one of three distances from the home plate—35 feet, 40 feet, and 43 feet.

When fast-pitch softball pitchers pitch, they drag their back foot as they are delivering the ball. This repeated dragging motion on the pitching lane can damage or destroy the turf and/or result in a depression being formed in the base layer beneath the turf. This damage can be time consuming and costly to repair and/or negatively affect the players' performance. On real grass and clay fields, this problem can be addressed by back-filling with dirt. This solution is unsuitable for use on an artificial turf field.

Figure 4:
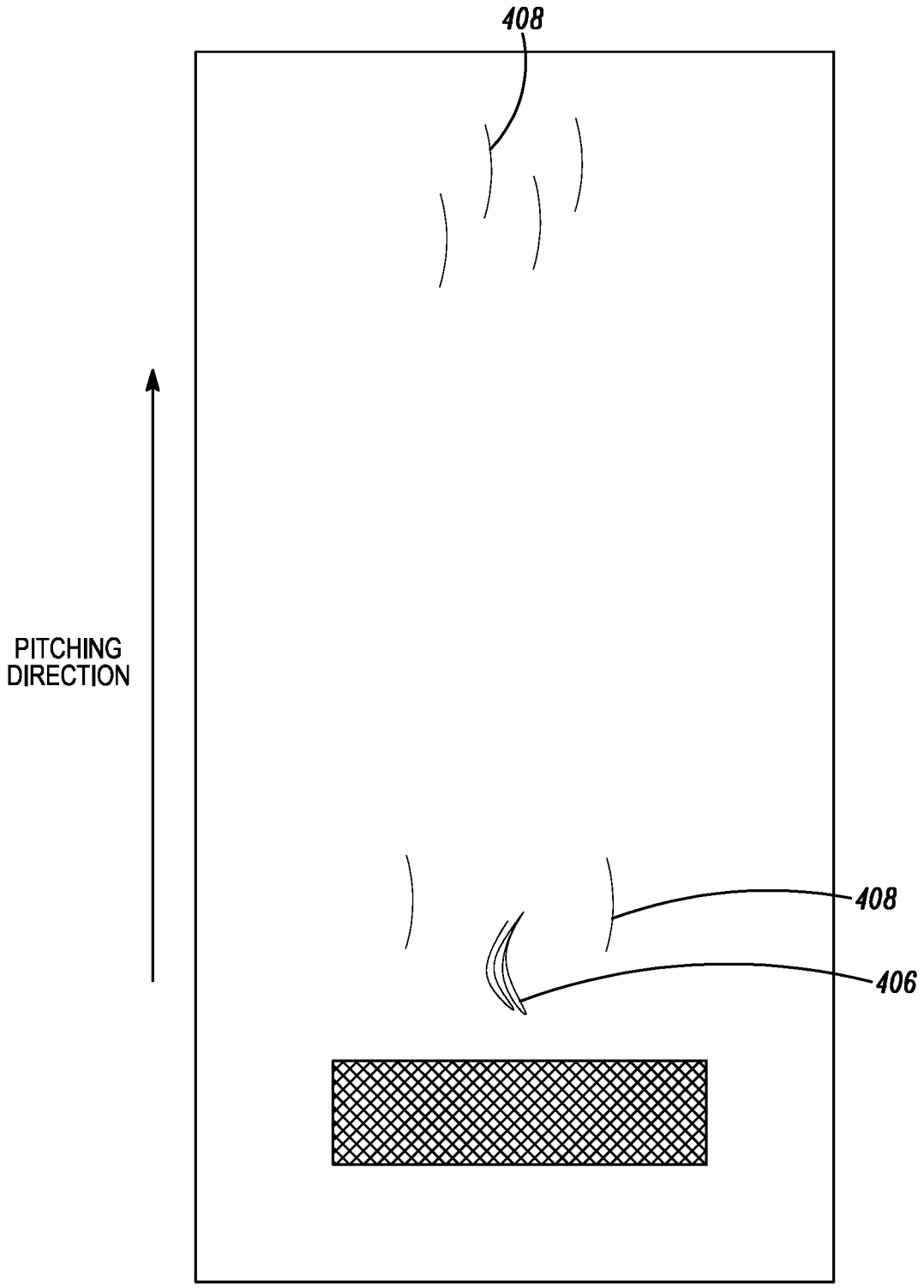
FIG. 4 PRIOR ART
FIG. 4 illustrates an artificial turf softball pitcher's lane after a game has been played.

Fast-pitch softball on artificial turf can damage the turf and/or integrity of the pitching lane. FIG. 4 illustrates an artificial turf softball pitcher's lane 210 after a game has been played. As can be seen, the circle, specifically in the area of the pitching lane, has been damaged by the pitcher's dragging leg as she pitches the ball. The artificial turf has been worn down and possibly torn in a number of places 408. Artificial turf may include rubber built into the surface to protect the turf. During fast-pitch softball pitching, the dragging leg may push the rubber back from the turf, thereby leaving the turf exposed and more easily torn. Additionally, FIG. 4 shows that a depression 406 has formed on the pitching lane from repeatedly dragging the back leg over the turf during pitching. Depending on the size of the pitcher and the mechanics of her pitch, the size, shape, and depth of the depression that is created in the pitching circle/mound can vary. In some cases a depression with a one foot diameter can occur that can be about three inches deep, though it will be understood that a depression of any radius, shape, or depth may be created depending on the pitcher, her pitch mechanics, and the number of pitches thrown.

Figure 5:
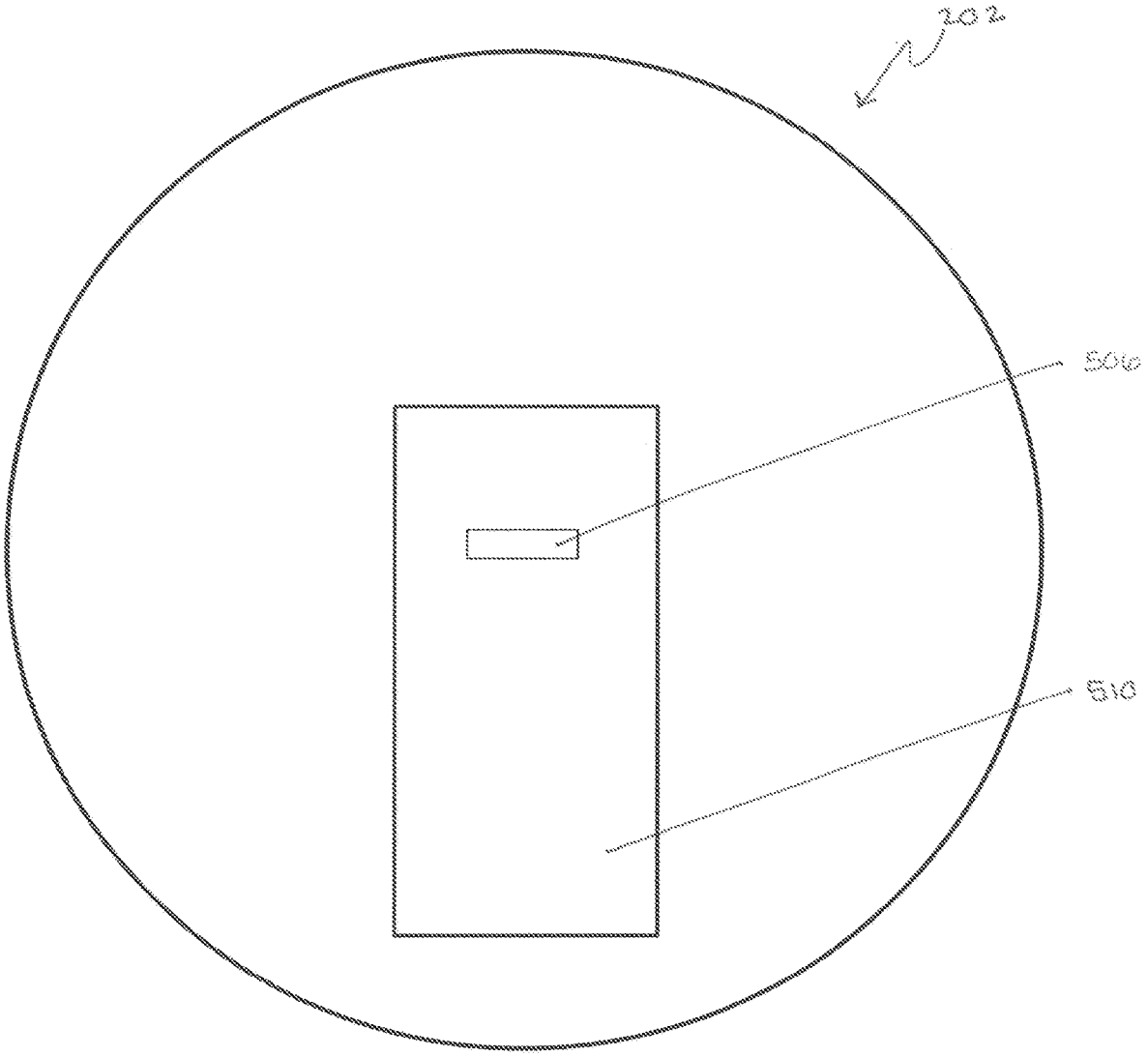
FIG. 5 illustrates a portable softball pitching lane, in accordance with one embodiment.

FIG. 5 illustrates a portable softball pitching lane 510 in accordance with one embodiment. As shown, the portable softball pitching lane 510 has a pitching rubber 506 and is in place in a pitcher's circle 202. The portable pitching lane may be picked up and moved from the field. The portable pitching lane has a weight such that the pitching lane can be moved from place to place but that will not move when a pitcher pitches. A surface layer of the portable softball pitching lane, comprising, for example, artificial turf, may be replaced, or partially replaced, when the surface layer sustains damage.

In general, the portable pitching lane 510 may have any dimensions that allow a pitcher to go through the motions of pitching. In some embodiments, the portable pitching lane 510 may have dimensions similar to a standard static pitching lane such as shown and described with respect to FIG. 3. For example, the portable pitching lane may have a length between about 6.5 feet and about 8.5 feet and a width between about 2.5 feet and about 4.5 feet. In one embodiment, the portable pitching lane is 8 feet long and 4 feet wide.

In another embodiment, the portable pitching lane may be approximately 11 feet long and 5 feet wide. This sizing allows a pitcher to have three feet behind the mound to step back and eight feet in front of the mound for full extension. Having the pitching plate 610 be eight feet long from the pitching rubber allows for a sixteen foot circle to be painted on the turf at 35 feet, 40 feet, and 43 feet, such that the plate may be moved and positioned so that the front lines up with the circle for instant change-over for teams of different ages and the mound distance would not need to be measured. It will be understood however, that the pitching plate 610 can have any suitable width and/or length that allows the pitcher to complete the pitch.

The portable softball pitching lanes shown and described address the problems of artificial turf pitching lanes discussed above. While softball pitching lanes of the present disclosure are discussed particularly with respect to use on an artificial turf field, the softball pitching lane lanes may be used on any surface—such as grass, dirt, wood, or cork in addition to artificial turf. In addition, the portable softball pitching lanes have advantages over static softball pitching lanes in addition to addressing issues of turf wear. For example, a portable pitching lane such as shown and described may be useful for pitching practice or warm ups not on a field.

As shown in FIG. 5, the portable pitching lane 510 may be positioned in a pitcher's circle 202. The pitching lane 510 need not be permanently affixed to the pitcher's circle 202. A pitching rubber 506 is positioned on the pitching lane 510. The pitching rubber 506 may be removably affixed. In some embodiments, the pitching lane 510 has a weight that is sufficiently light to allow it to be readily moved by one or more people, while at the same time having enough weight that it will not move or slide when a pitcher stands on it and delivers a pitch. During tournaments, the pitching lane 510 may be moved forward or backward such that the pitching rubber 506 may be positioned the regulation distance from home plate for the teams playing. In some embodiments the pitching lane 510 may weigh approximately 150 pounds. In other embodiments, the pitching lane 510 may weigh in the range of from about 120 to about 150 pounds. In still other embodiments, the pitching lane 510 may weigh from about 150 pounds to about 190 pounds. It will be understood however, that the pitching lane may be designed and configured to have any weight. For example, the pitching lane may weigh less than 120 pounds to make it easier to move and which may still provide sufficient weight that it may not slide when players that are younger and/or weigh less are playing. Alternatively, the pitching lane may weigh more than 190 pounds to ensure that minimal movement occurs during pitching, and may also be suitable for instances where the plate will not need to be moved as frequently and/or as far as may be the case in other instances.

Figure 6:
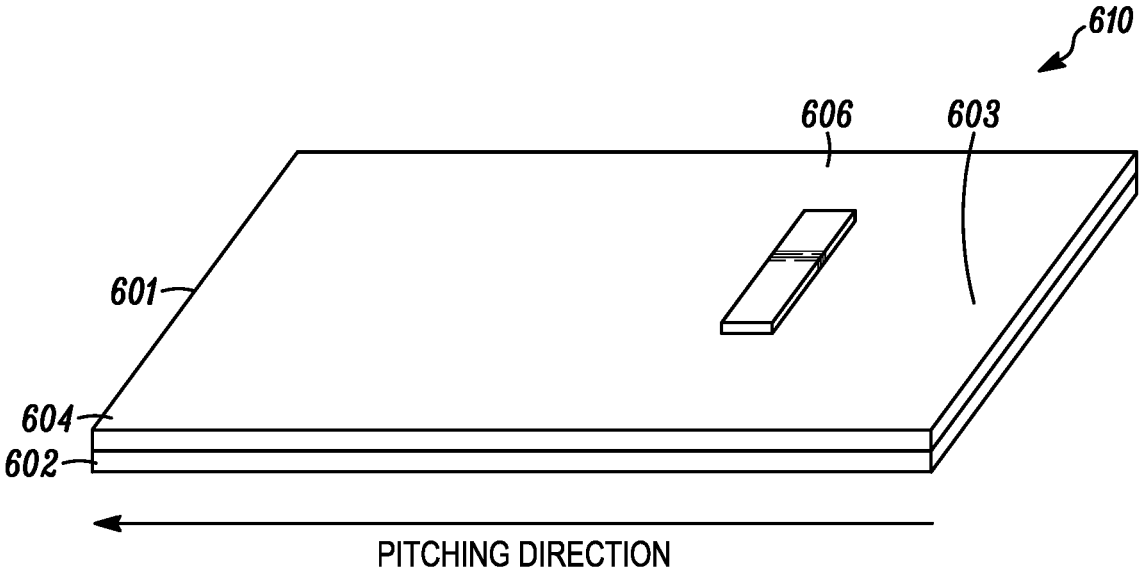
FIG. 6 illustrates a perspective view of a pitching lane, in accordance with one embodiment.

FIG. 6 illustrates a perspective view of a pitching lane 610 in accordance with one embodiment. The pitching lane 610 includes a foundation layer 602, a surface layer 604, and a pitching rubber 606. In some embodiments there may be one or more additional layers as well as those shown in FIG. 6 and/or each of the foundation layer 602 and the surface layer 604 may themselves comprise multiple layers. Additional may provide increased durability, improved feel, non-slip properties, etc. In some embodiments the pitching lane 610 may have beveled or trimmed edges so that the pitching lane 610 may lay substantially flush with the ground. A granulated self-adhesive strip may be positioned on the bottom of the foundation layer 602 to prevent sliding, in some embodiments.

Figure 7:
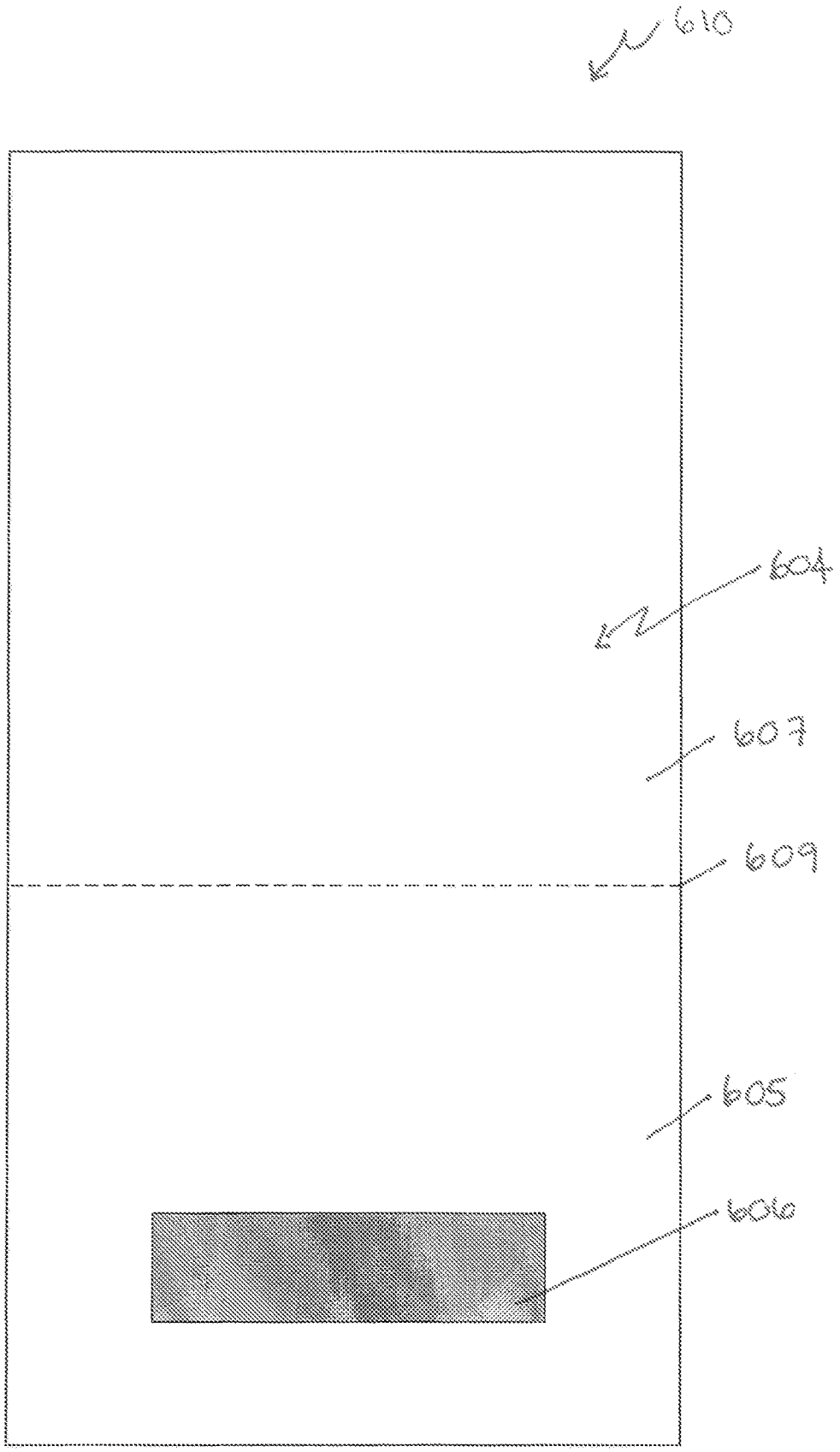
FIG. 7 illustrates a top surface of the pitching lane, in accordance with one embodiment.

FIG. 7 illustrates a top surface of the portable pitching lane 610, in accordance with one embodiment. The portable pitching lane 610 has a front edge 601 and a back edge 603. The pitching direction is from the back edge, or, more specifically, the pitching rubber 606, to the front edge 601. The top surface comprises the surface layer 604 and the pitching rubber 606. The surface layer 604 is the layer upon which the pitcher stands during pitching. The surface layer 604 may thus comprise any material that provides a suitable surface for pitching. In one embodiment, the surface layer 604 comprises artificial turf. For example, the surface layer 604 may comprise an commercially available artificial turf such as a 60 oz. nylon AstroTurf®.

In some embodiments, the surface layer 604 may include a rubber layer such as a rubber pad. In one embodiment, for example, the surface layer 604 may include a rubber pad (positioned directly against the foundation layer) and an artificial turf layer. In other embodiments the surface layer 604 may not include a rubber layer.

The surface layer 604 may comprise a single piece of material or may comprise multiple pieces of material. For example, in the embodiment of FIG. 7, the surface layer 604 comprises two pieces of material 605 and 607 that meet at line 609. This may be done so that an area of surface layer 604 more likely to be damaged during use can be replaced without necessitating replacement of the entire surface layer 604. In general, the area of the pitching layer in front of (in the direction of the pitch) the pitching rubber 606 tends to incur the most damage—specifically from dragging of the pitcher's toe when pitching the ball. In addition, the landing area near the front edge 601 of the pitching lane can sustain wear.

The surface layer 604 may be affixed to the foundation layer 602 by any suitable means, including, but not limited to adhering the surface layer 604 to the foundation layer 602 and/or mechanically affixing the layers, using nails, screws, or any other suitable means or combination of means. In some embodiments, a floor glue or epoxy may be used alone or in combination with nails or screws to affix the surface layer 604 to the foundation layer 602. In one embodiment, Nordot Exclusive Glue is used to adhere the surface layer 604 to the foundation layer 602.

In other embodiments, the surface layer 604 may be affixed to the foundation layer 602 by a removably secure means. In one embodiment, the removably secure means may be a hook and loop fastener such as Velcro®, for example. Other means of detachably securing the surface layer 604 to the foundation layer 602 may alternatively be used. In such embodiments, in the event that the artificial turf layer becomes damaged, the damaged portion may be removed and replaced with an appropriately sized replacement piece of artificial turf. For example, if small area of a large piece of surface layer 604 is damaged, the small area may be cut out and removed with a small piece being attached to the foundation layer 602 in its place.

In one embodiment, such as that shown in FIG. 7, multiple methods of fixing the surface layer 604 may be used. For example, the first piece of material 605, the material most likely to sustain damage during use, may be fixed to the foundation layer using Velcro® and the second piece of material 607 may be fixed to the foundation layer using an adhesive. In this manner, the first piece of material 605 may be easily pulled up and replaced if damaged. While FIG. 7 illustrates two pieces of material, it is to be appreciated that any suitable number of pieces of material may be used.

Figure 8:
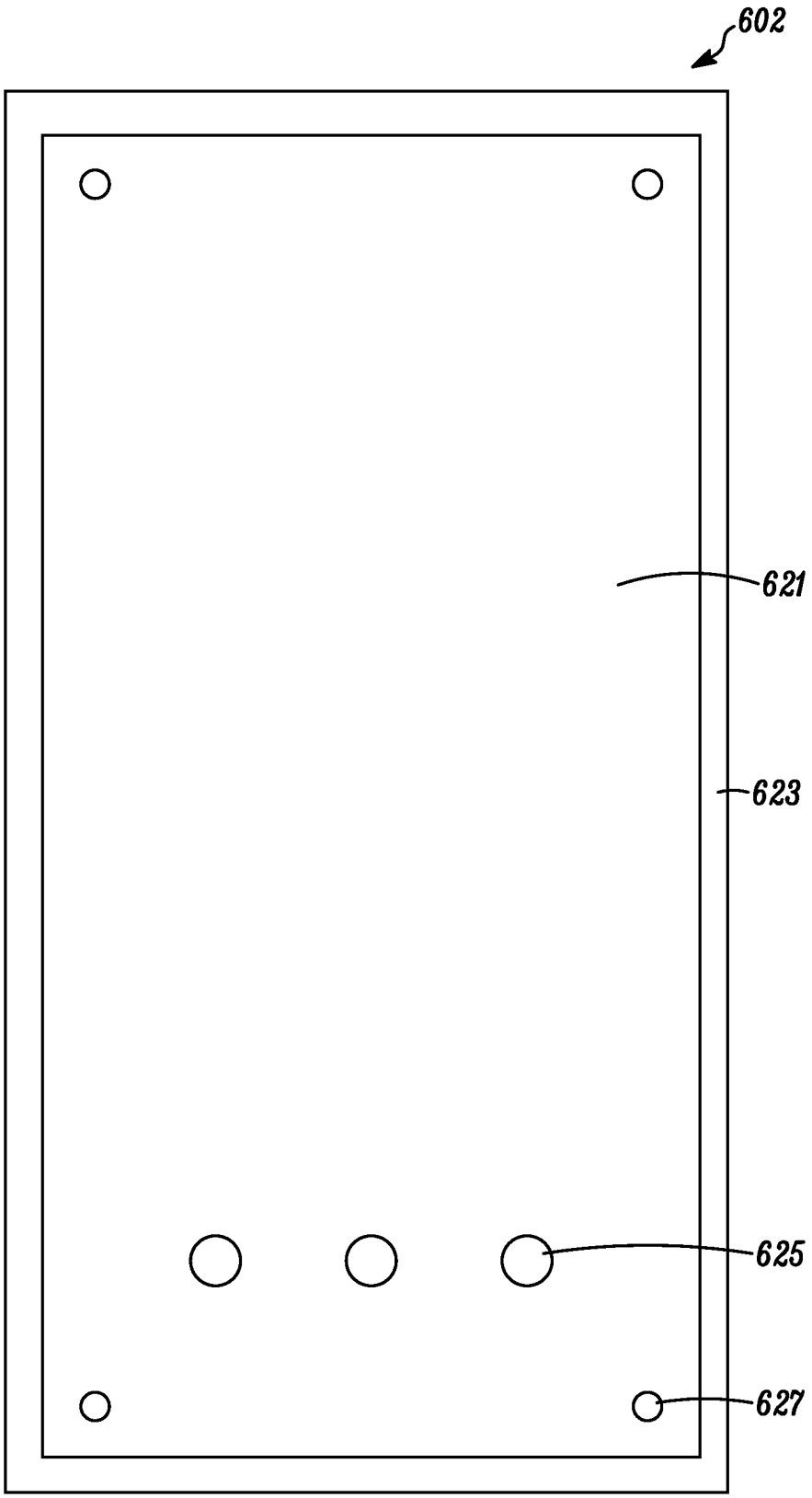
FIG. 8 illustrates a bottom surface of the foundation layer of a pitching lane, in accordance with one embodiment.

FIG. 8 illustrates a bottom surface of the foundation layer 602 of a pitching lane, in accordance with one embodiment. As shown, the foundation layer 602 may include a central surface 621, a lip 623, one or more receptacles 625, and one or more insertion holes 627. In some embodiments, the bottom surface of the foundation layer may be coated with a gel coating, polyurethane coating or other. This may be useful for protecting the surface of the foundation layer from wear or for protecting a user from splintering from the foundation layer (for example, with a fiberglass foundation layer) during handling.

The foundation layer 602 may provide the pitching lane with strength, weight, and rigidity. In some embodiments the foundation layer 602 may comprise, for example, any of, or a combination of, a metal, a metal alloy, a plastic, wood, plywood, fiberglass, etc. The foundation layer may comprise ¼" thick aluminum in some embodiments. In another embodiment, the foundation layer 602 may comprise a three piece layer of a 3 oz. fiberglass mat, a ⅜" balsa, and a 3 oz. fiberglass mat, with the balsa being sandwiched between the two mats.

The thickness of the foundation layer may be selected such that a desired weight of the pitching lane is achieved, while also providing a rigidity such that the pitching plate does not bend or flex during pitching to a degree that would negatively impact pitching performance. In some embodiments, the foundation layer is approximately ¼" thick. In general, the thickness of the foundation layer may be any suitable thickness and may be more or less ¼" thick. The thickness of the foundation layer(s) may depend on the material(s) that is used to comprise the foundation layer(s). Further, the thickness of the foundation layer may vary depending on the intended use of the portable pitching lane. For example, it may be desirable to have a thinner portable pitching lane when the portable pitching lane will be primarily used in place on a pitcher's circle. In contrast, it may not be necessary to have a portable pitching lane substantially flush with the ground where the portable pitching lane will be used off of a softball field for practice.

In some embodiments, the foundation layer may be a single layer or may comprise two or more layers. The two or more layers may be the same material or may be different materials. Multiple layers may have different thicknesses from one another or the same thickness. Multiple foundation layers may be affixed to one another by any suitable means, including, but not limited to an adhesive, chemical means of affixing one layer to another, and/or mechanical means of securing one layer to another, such as nail and/or screw, or any other method for attaching one foundation layer to another.

The lip 623 reduces a sharp edge of the sides of the portable pitching lane. In various embodiments, the lip 623 may be provided along an entire perimeter of the bottom of the foundation layer. In other embodiments, the lip 623 may be provided along portions of each of the top, bottom, or side edges of the foundation layer. In some embodiments, the lip 623 may be provided just along corners of the foundation layer. In some embodiments, the lip 623 is minimized or removed so bring the surface layer of the pitching lane near flush with the playing surface of the softball field.

Figure 9:
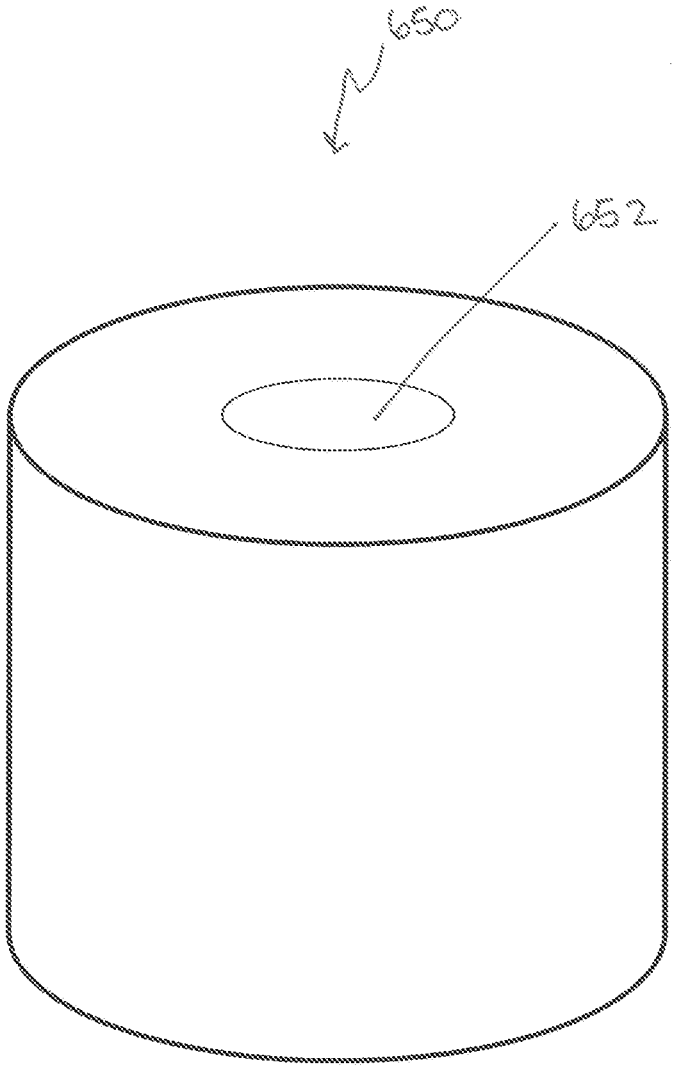
FIG. 9 illustrates a housing, in accordance with one embodiment.

A bottom surface of receptacles 625 can be seen in FIG. 8. Each of the receptacles 625 receives a housing. FIG. 9 illustrates a housing 650 in accordance with one embodiment. As shown, the housing 650 has a central bore 652. The housing 650 is positioned in the receptacle 605 of the foundation layer 602 such that the bore 652 opens upwards towards the surface layer. The central bore 652 receives a stud from a pitching rubber such that the pitching rubber is secured in place on the pitching lane. The diameter of the bore 652 may be such that a stud from the pitching rubber is engaged by the bore 652 and there is minimal room for movement of the stud within the housing 650. In the embodiment shown in FIG. 8, three receptacles 625 are provided. In other embodiments, more or fewer receptacles may be provided. Each housing may be embedded into the receptacles 625 of the foundation layer 602.

Figure 10:
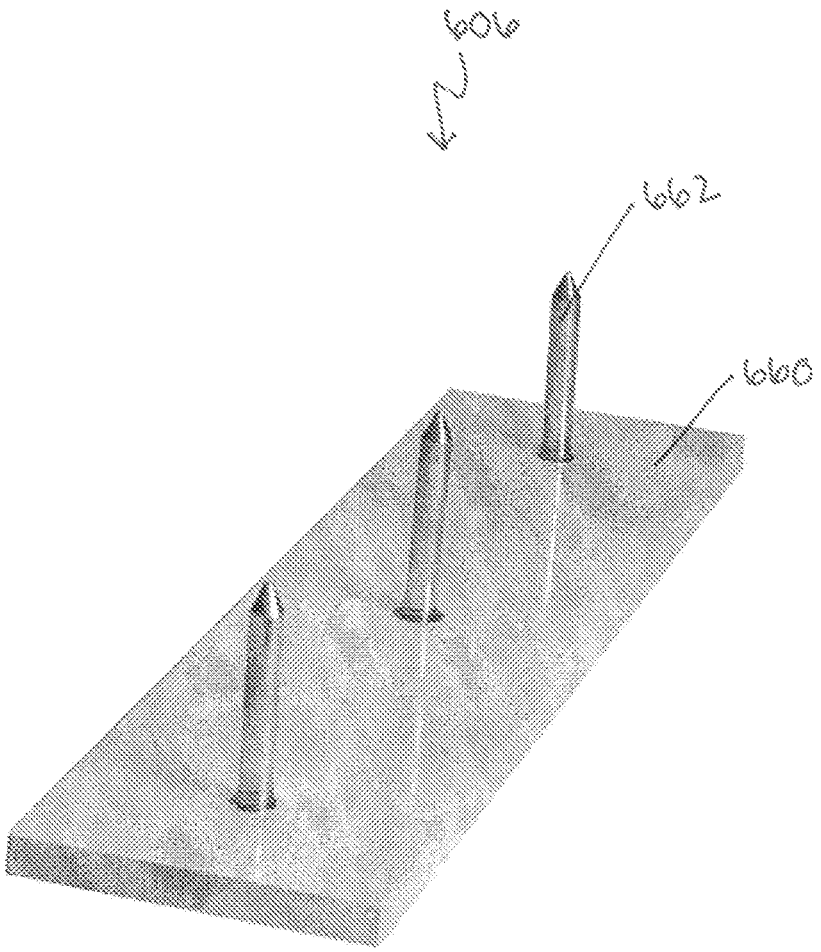
FIG. 10 illustrates a pitching rubber, in accordance with one embodiment.

FIG. 10 illustrates a pitching rubber 606, in accordance with one embodiment. The pitching rubber comprises a body 660 and studs 662. The body 660 may comprise any suitable material. In one embodiment, the body comprises a heavy-duty 1.75 cm thick UV-resistant rubber. The studs 662 may be received by housings 650. In one embodiment the studs are nickel-plated 3" steel studs. One end of the studs may be threaded such that they may threaded into holes in the pitching rubber.

The pitching rubber may be provided in any suitable size. In general, it may be desirable to provide the pitching rubber in two sizes: an official size and a youth size. The official size pitching rubber may be 6"×24" and the youth size pitching rubber may be 4"×18". Regardless of the size of the pitching rubber, the studs may be provided at locations corresponding with the housings provided in the foundation layer, as described with respect to FIG. 8. For example, a first stud may be provided at the center of the pitching rubber, a second stud eight inches to the left of the center of the pitching rubber, and a third stud eight inches to the right of the pitching rubber. In one embodiment, the spacing is 7.25" center to center. In another embodiment, the spacing is 9.25" center to center.

Returning now to FIG. 8, the one or more insertion holes 627 may be used to receive removable spikes for engaging the surface upon which the pitching lane is placed. The removable spikes ensure that the pitching lane has minimal movement on artificial turf when in use. They may be removed when the pitching lane is used on a different surface.

In some embodiments, the insertion holes 627 are provided eight inches from each of a side edge of the pitching lane and a top or bottom edge of the pitching lane, thus in a evenly eight inches from a corner of the portable pitching lane. In some embodiments, the insertion holes 627 may have an interior threading to receive a threaded end of a spike. The spikes may be any suitable material. For example, the spikes may be rubber, plastic, or mold. In general, the spikes are sufficiently long to engage the surface upon which the pitching lane is placed but not so long as to damage the surface. With particular reference to artificial turf, the spikes may be designed to anchor into pellets provided in the artificial turf without puncturing the turf. In some embodiments, the spikes may be between approximately 1 inch and approximately 2.5 inches in length. In one embodiment, the spikes may be 2 inches in length. It is to be appreciated that, in some embodiments, it may not be desirable to use the pitching lane with spikes. For example, when using the pitching lane on a wood floor, spikes may not be inserted into the insertion holes. Further, in some embodiments, no insertion holes may be provided.

Figure 11:
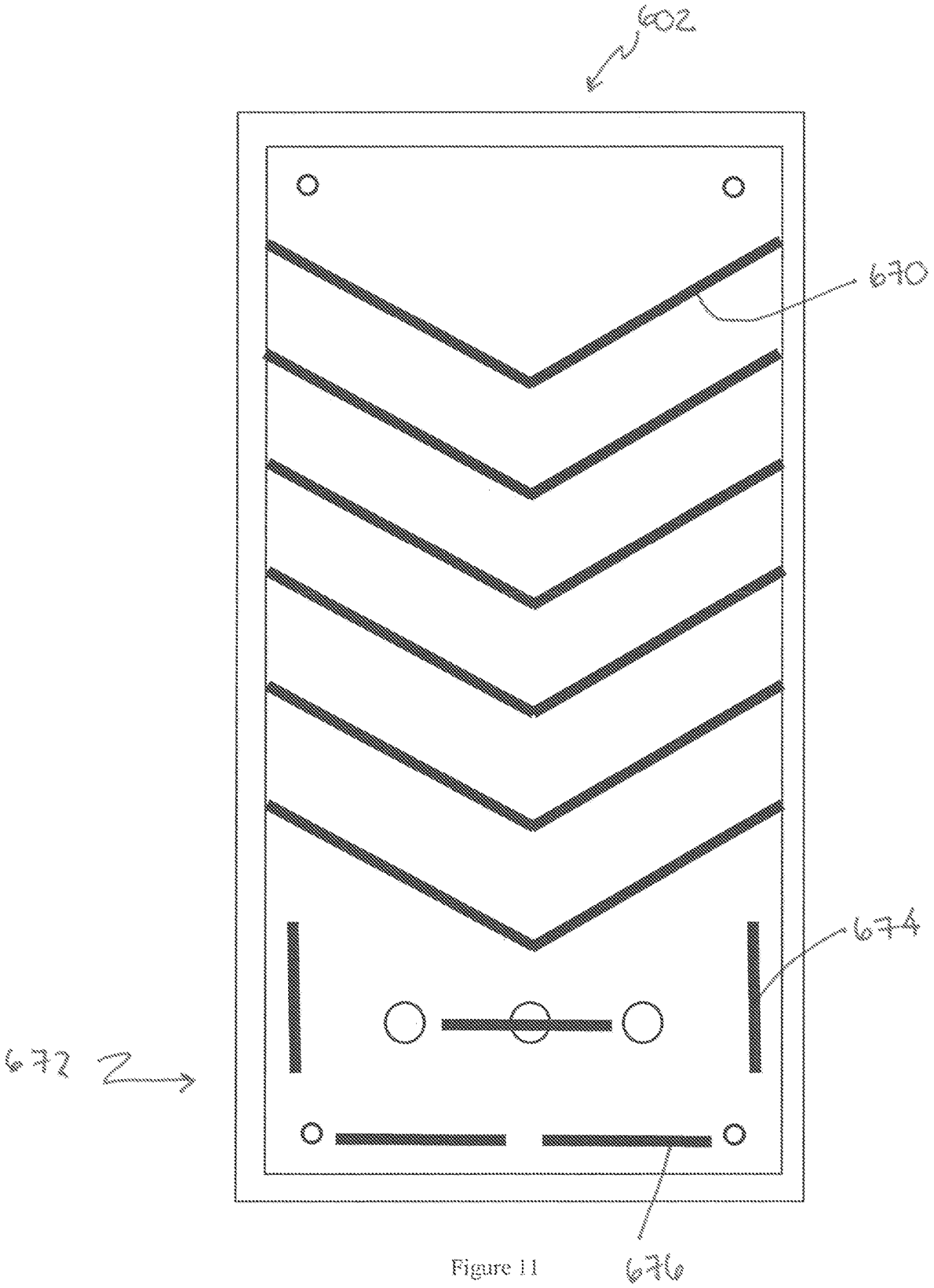
FIG. 11 illustrates a bottom surface of a foundation layer having ribs fixed thereto, in accordance with one embodiment.

FIG. 11 illustrates a bottom surface of a foundation layer 602 having ribs fixed thereto, in accordance with one embodiment. The ribs may assist in distributing weight and/or may assist in keeping the pitching plate from sliding when in use and/or may provide additional sturdiness. The ribs may be spaced in such a way that weight from landing on the pitching lane is dispersed and shock is absorbed. This reduces sliding of the pitching lane on wood flooring as well as turf fields.

The ribs may be formed from any suitable material depending on primarily utility of the ribs. For example, the ribs may be formed of a EPDM (ethylene propylene diene monomer) roofing material, rubber such as elephant bark rubber, or other material having a texture that grips the ground, may be used for the ribs to reduce or prevent slipping or sliding of the plate during use. In general, when the ribs are used for reducing slippage, the rib material may be any material that may help reduce or eliminate sliding, for example, any rubber and/or other material that has a texture to it that may help grip the ground and reduce the potential for movement. The ribs may be fixed to the bottom surface of the foundation layer 602 in any suitable manner. For example, the ribs may be fixed to the bottom surface of the foundation layer 602 with an adhesive.

In some embodiments, a rib may be provided over the area of receptacles 625 of FIG. 8 such that the rib may receive the studs from the pitching rubber rather than providing receptacles for receiving the studs from the pitching rubber.

The ribs may be any suitable size and may be provided in any suitable arrangement. Each of the ribs may be the same size and shape as the others or one or more of the ribs may have a different size and shape from others. The ribs may be placed in any one or more locations on the bottom of the foundation layer and in any pattern, including covering the entire surface of the bottom of the foundation layer In the embodiment shown in FIG. 11, six ribs 670 are placed in V shapes pointed towards the pitching rubber end 672 of the pitching lane. Additional ribs are placed at the pitching rubber end 672 of the pitching lane. Two ribs 674 are placed extending lengthwise at opposite sides of the pitching rubber end 672 of the pitching lane and two ribs 676 are placed extending widthwise at the pitching rubber end 672 of the pitching lane. In some embodiments, a rib may be provided over the area of receptacles In another embodiment, the ribs may be placed vertically down the center on the bottom of the foundation layer. Each rib may be 16" long and 3" wide, for example. It is to be understood that the ribs may be any suitable size and shape, and that the plurality of ribs may have the same or different sizes and shapes. Additionally or alternatively, one or more corners and/or edges of the bottom of the foundation layer, in some embodiments, may have a material attached to minimize or eliminate sliding of the plate while in use. For example, in one embodiment, each of the four corners of the bottom of the foundation layer glued thereto a 1" square of EPDM roofing material.

Figure 12:
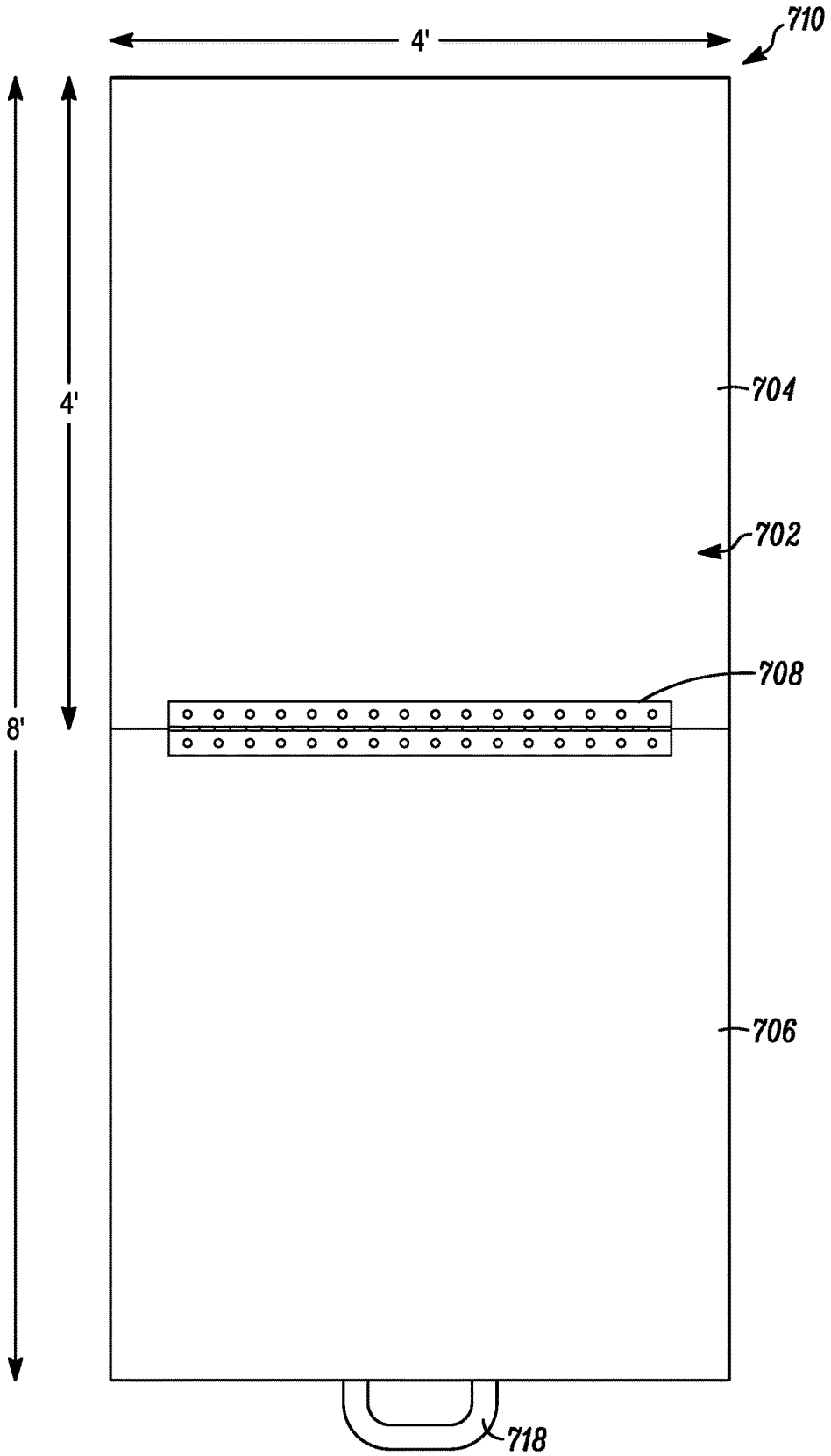
FIG. 12 illustrates a folding portable pitching lane, in accordance to one embodiment.

FIG. 12 illustrates a folding portable pitching lane 710, in accordance to one embodiment. Like other embodiments of portable pitching lanes previously described, the folding portable pitching lane 710 may include a foundation layer, a surface layer, and a pitching rubber. FIG. 12 illustrates an bottom surface of the foundation layer 702, that is, the surface that is against the surface of the softball field when the portable pitching plane is in use. As shown, the foundation layer 702 is divided into a plurality of component pieces. In the embodiment shown, two component pieces 704 and 706 are provided, each component piece being approximately the same size. For example, each component piece 704 and 706 may be approximately 4 feet by 4 feet. In other embodiments other sizes may be used, the two component pieces may not be evenly sized, and/or more than two component pieces may be provided.

As shown in FIG. 12, the component pieces 704 and 706 of the foundation layer 702 are joined with a hinge 708. The hinge 708 may be, for example, a piano hinge. The hinge 708 may have any suitable size for joining the component pieces 704 and 704 and allowing them to fold towards one another. In some embodiments, more than one hinge may be provided. In one embodiment, the hinge may be approximately 44 inches long and approximately 1.5 inches wide. A handle 718 may be provided at one or both ends of the folding portable pitching lane 710 or at a different location of the folding portable pitching lane 710 such as along a side of the folding portable pitching lane 710. In other embodiments, no handle may be provided.

In an alternative embodiment, the hinge may be provided on a top surface of the foundation layer 702, that is, the surface that is beneath the surface layer when the portable pitching lane is assembled. In such an embodiment, the surface layer of the folding portable pitching lane 710 may be provided over the hinged foundation layer 702. In some embodiments, a liner may be provided between the hinged foundation layer 702 and the surface layer, the liner masking the rise of the hinge 708.

Accordingly, the foldable portable pitching lane 170 includes a first component piece 704 and a second component piece 706. The first component piece 704 comprises a first piece foundation layer and a first piece surface layer. The second component piece 706 comprises a second piece foundation layer and a second piece surface layer. A hinge 708 connects the first component piece to the second component piece. The foldable portable pitching lane is movable from place to place when not in use, but does not move when in use.

Figure 13:
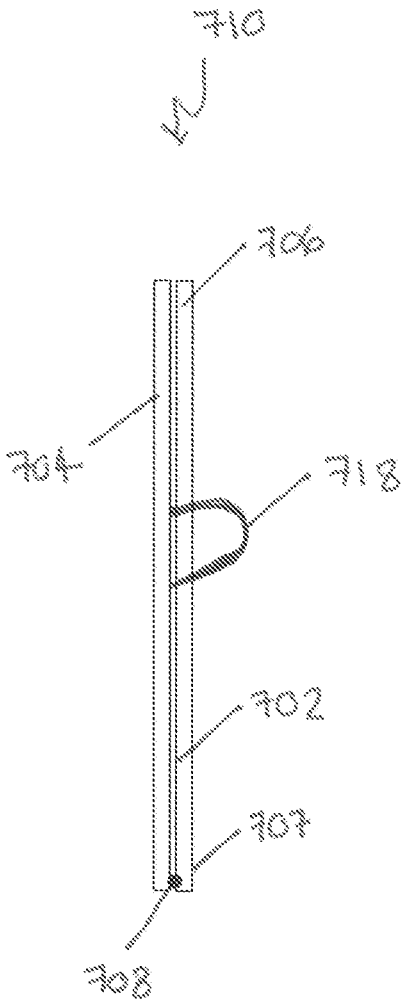
FIG. 13 illustrates a folding portable pitching lane in the folded position, in accordance with one embodiment.

FIG. 13 illustrates the folding portable pitching lane 710 in the folded position, in accordance with one embodiment. As shown, in the folded position, the bottom surface of the foundation layer 702, upon which the hinge 708 is mounted, faces inwardly. The surface layer 707, for example comprising artificial turf, faces outwardly. The folding portable pitching lane 710 is compacted and a handle 718 is available for carrying the folding portable pitching lane 710. In the embodiment shown, the handle 718 is provided on one or more side edges. In alternative embodiments, the handle may be provided on the front edge and/or the back edge.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A portable pitching lane comprising:

a front edge;

a back edge;

a rigid foundation layer extending from the front edge to the back edge, wherein the foundation layer is configured to be flush to ground during use, wherein the foundation layer includes two sets of at least two receptacles each set being provided at a different position between the front edge and the back edge, such that the pitching rubber can be positioned at two different distances from home plate without moving the portable pitching lane;

a housing provided in each of the receptacles;

a surface layer positioned over the foundation layer and configured to be parallel to the ground during use, wherein the surface layer comprises a first portion and a second portion and wherein the first portion is configured for removal and replacement without requiring removal of the second portion; and a pitching rubber having at least two studs, each for receipt by one of the housings of the foundation layer for removably affixing the pitching rubber to the portable pitching lane, wherein the pitching rubber can be positioned at two different distances from home plate without moving the portable pitching lane, wherein when the pitching rubber is in position on the surface layer, the pitching rubber extends upwardly from the surface layer, and wherein the pitching rubber may be removed from the portable pitching lane;

wherein the portable pitching lane weighs at least about 120 pounds such that it resists movement when in use.

2. The portable pitching lane of claim 1, wherein the surface layer comprises artificial turf.

3. The portable pitching lane of claim 1, further comprising ribs on a bottom surface of the foundation layer, the ribs being configured for assisting distributing weight.

4. The portable pitching lane of claim 1, wherein the surface layer comprises a plurality of component pieces, wherein one of the plurality of component pieces is affixed to the foundation layer in a manner such that the one of the plurality of component pieces can be replaced without requiring replacement of other component pieces.

5. The portable pitching lane of claim 4, wherein one of the plurality of component pieces is fixed to the foundation layer using a hook and loop fastener and can be replaced without requiring replacement of other component pieces.

6. The portable pitching lane of claim 1, wherein the portable pitching lane has a length of between about 6.5 feet and about 8.5 feet and a width between about 2.5 feet and 4.5 feet.

7. The portable pitching lane of claim 1, further comprising a rubber pad between the foundation layer and the surface layer.

8. The portable pitching lane of claim 1, wherein the housing includes a bore for receiving the stud of the pitching rubber.

9. The portable pitching lane of claim 1, wherein the portable pitching lane is positioned at a distance from a home plate and wherein the foundation layer includes a plurality of sets of two receptacles, each of the sets being at a different position between the front edge and the back edge, such that the pitching rubber can be positioned at a plurality different distances from home plate without moving the portable pitching lane.

10. A portable pitching lane comprising:

a front edge;

a back edge;

a rigid foundation layer having ribs on a bottom surface thereof, the ribs being provided on a bottom surface of the foundation layer spaced such that weight from landing on the pitching lane is dispersed and shock is absorbed;

a receptacle provided in the foundation layer;

a housing provided in the receptacle;

a surface layer positioned over the foundation layer and configured to be parallel to the ground during use, the surface layer comprising first and second portions, each of the first and second portions comprising artificial turf, wherein the first portion is configured for removal and replacement without requiring removal of the second portion;

a pitching rubber having a stud for receipt by the housing for removably affixing the pitching rubber to the pitching lane, wherein the pitching rubber extends upwardly from the surface layer when in position, wherein the pitching rubber may be removed from the portable pitching lane; and one or more removable spikes extending downwardly from the foundation layer.

11. The portable pitching lane of claim 10, wherein the portable pitching lane is positioned at a distance from a home plate and wherein the foundation layer includes three sets of receptacles for receiving the pitching rubber, each set being provided at a different position between the front edge and the back edge, such that the pitching rubber can be positioned at 3 different distances from home plate without moving the portable pitching lane.

12. The portable pitching lane of claim 10, further comprising a granulated strip for positioning on a bottom surface of the foundation layer.

13. The portable pitching lane of claim 10, wherein the foundation layer includes an insertion hole correlating to each removable spike for receiving the removable spike.

14. A portable pitching lane comprising:

a front edge;

a back edge;

a rigid foundation layer extending from the front edge to the back edge, wherein the foundation layer is configured to be flush to ground during use, wherein the foundation layer includes two sets of at least two receptacles each set being provided at a different position between the front edge and the back edge, such that the pitching rubber can be positioned at two different distances from home plate without moving the portable pitching lane;

ribs on a bottom surface of the foundation layer, the ribs being configured for assisting distributing weight;

a housing provided in each of the receptacles;

a surface layer positioned over the foundation layer and configured to be parallel to the ground during use; and a pitching rubber having at least two studs, each for receipt by one of the housings of the foundation layer for removably affixing the pitching rubber to the portable pitching lane, wherein the pitching rubber can be positioned at two different distances from home plate without moving the portable pitching lane, wherein when the pitching rubber is in position on the surface layer, the pitching rubber extends upwardly from the surface layer, and wherein the pitching rubber may be removed from the portable pitching lane;

wherein the portable pitching lane weighs at least about 120 pounds such that it resists movement when in use.

* * * * *